US012612793B1

(12) United States Patent
Martin

(10) Patent No.: US 12,612,793 B1
(45) Date of Patent: Apr. 28, 2026

(54) PROTECTIVE TARP CONSTRUCTION

(71) Applicant: Dean Martin, Waxahachie, TX (US)

(72) Inventor: Dean Martin, Waxahachie, TX (US)

( * ) Notice: Subject to any disclaimer, the term of this patent is extended or adjusted under 35 U.S.C. 154(b) by 133 days.

(21) Appl. No.: 18/112,264

(22) Filed: Feb. 21, 2023

(51) Int. Cl.
*E04G 21/28* (2006.01)
*E04G 21/24* (2006.01)

(52) U.S. Cl.
CPC ..... *E04G 21/28* (2013.01); *E04G 2021/248* (2013.01)

(58) Field of Classification Search
CPC . E04G 2021/248; E04G 21/28; A62C 3/0214; A62C 3/0257; E04D 5/06; E04B 2001/949
See application file for complete search history.

(56) References Cited

U.S. PATENT DOCUMENTS 3,162,566 A * 12/1964 Katz ..... E04B 1/78 220/592.2
3,862,876 A * 1/1975 Graves ..... E04G 21/28 47/9
4,590,714 A * 5/1986 Walker ..... B32B 27/26 5/417
5,001,005 A * 3/1991 Blanpied ..... B32B 27/20 428/326
5,091,243 A * 2/1992 Tolbert ..... A47C 31/001 428/920
6,329,038 B1 * 12/2001 Christoffersen ..... A47F 3/0469 428/68
6,363,661 B1 * 4/2002 Myers ..... A01F 25/13 52/2.13
6,966,152 B2 * 11/2005 Glynos ..... A01F 25/13 248/910
7,000,359 B2 * 2/2006 Meyer ..... E04B 1/66 52/506.01
7,568,528 B1 * 8/2009 Miller ..... A62C 2/10 442/302
9,598,860 B2 * 3/2017 Davis ..... A62C 3/0214
10,246,889 B1 * 4/2019 Nogueras ..... E04G 21/28
11,773,611 B1 * 10/2023 Fineran ..... E04G 21/30 52/3
2004/0194393 A1 * 10/2004 Horman ..... E04B 1/66 52/3
2005/0150664 A1 * 7/2005 Miller ..... A62C 3/0257 169/48
2006/0010815 A1 * 1/2006 Dixon ..... E04G 21/28 52/514
2006/0207773 A1 * 9/2006 Peltz ..... B60P 7/0876 169/48
2008/0000648 A1 * 1/2008 Kleff ..... A62C 8/08 169/48
2009/0013610 A1 * 1/2009 Glynos ..... B65G 3/02 52/3

(Continued)

*Primary Examiner* — Gisele D Ford
(74) *Attorney, Agent, or Firm* — Jeffrey Roddy

(57) ABSTRACT

A protective tarp construction includes a top and bottom plastic layer with at least one layer of absorbent material such as cellulose which may be paired with a superabsorbent polymer, between the top and bottom layers forming a sandwiched construction. The system includes one or more conduits for the introduction of a fluid such as water to the cellulose matting in order to saturate the absorbent material of the sandwiched construction and portions of the tarp construction may be separable along perforated separation lines.

5 Claims, 11 Drawing Sheets

(56) References Cited

U.S. PATENT DOCUMENTS

| | | | | |
|---|---|---|---|---|
| 2009/0056780 | A1* | 3/2009 | Glynos | A01F 25/13 135/119 |
| 2012/0145418 | A1* | 6/2012 | Su | A62C 3/0214 169/45 |
| 2012/0244315 | A1* | 9/2012 | Barrego | E04G 21/28 428/141 |
| 2016/0047120 | A1* | 2/2016 | Davis | A62C 3/0214 52/4 |
| 2017/0021208 | A1* | 1/2017 | Dor-El | A62C 3/0214 |
| 2018/0078801 | A1* | 3/2018 | Perkovich | A62C 35/68 |
| 2020/0056388 | A1* | 2/2020 | Cohen | B60J 7/10 |
| 2020/0147423 | A1* | 5/2020 | Paull | A62C 3/0214 |
| 2020/0240138 | A1* | 7/2020 | Ouimette | E04B 1/665 |
| 2021/0324641 | A1* | 10/2021 | Jimenez | E04G 21/28 |
| 2022/0143438 | A1* | 5/2022 | Stanley | A62C 3/0214 |
| 2022/0194047 | A1* | 6/2022 | Zhang | B32B 37/182 |
| 2022/0288434 | A1* | 9/2022 | Olin | A62C 99/0018 |
| 2023/0398391 | A1* | 12/2023 | Owsley | A62C 3/0214 |
| 2024/0076888 | A1* | 3/2024 | Latimore | E04G 21/24 |
| 2024/0139566 | A1* | 5/2024 | Smith | A62C 5/022 |

* cited by examiner

PROTECTIVE TARP CONSTRUCTION

FIELD OF THE INVENTION

The present invention relates to protective tarps and similar coverings.

BACKGROUND OF THE INVENTION

Protective tarps intended to cover and shield items from environmental conditions; e.g., heat, cold, rain, moisture and dust and debris are long known in the art. More specifically, so called blue tarps are used extensively as a temporary protective cover over roof damage sustained in a storm. Typically, the blue tarps are placed over the damaged section of roof and weighted with sand bags or attached to boards at the outer bounds of the tarp where the boards are then nailed to the roof in order to prevent the tarp from being blown off the roof by wind. Hence, using conventional blue tarps, standard practice further damages the area of the roof by puncturing the shingles that surround the original damage and necessitates additional repair work and cost. Accordingly, it would be desirable to provide an improved protective tarp that may quickly be installed and does not require weighting down with sand bags or nailing through the undamaged roof sections.

SUMMARY OF THE EMBODIMENTS

In a general example implementation, a fluid weighted tarp includes a sandwiched construction with at least a top layer, a bottom layer and one or more divided cavities between the top and bottom layer, and one or more layers of absorbent material reside in the one or more divided cavities.

In an aspect combinable with the foregoing example, water or other fluid is introduced into the one or more divided cavities by pouring or pumping.

In an aspect combinable with any other aspect described herein, the one or more cavities include one or more fluid inlets.

In an aspect combinable with any other aspect described herein, one or more hoses may be connected to one or more of the inlets.

In an aspect combinable with any other aspect described herein, the one or more layers of absorbent material may include cellulose fiber.

In an aspect combinable with any other aspect described herein, the one or more layers of absorbent material may include sodium polyacrylate.

In an aspect combinable with any other aspect described herein, the sandwiched construction may include sections that are separable one from another via perforated tear lines.

In an aspect combinable with any other aspect described herein, the sandwiched construction may include pull away outer layers that expose one or more absorbent layers when the outer layer is displaced.

In an aspect combinable with any other aspect described herein, pull-away outer layers may be restored to their original position via one or more adhesive sections in order to cover the absorbent layers and re-seal the tarp.

Advantages

In the various implementations described herein, because the absorbent material may be cellulose fiber or a combination of cellulose fiber and sodium polyacrylate. Cellulose fiber alone may hold up to 10× its weight in water. Water retention increases greatly with the addition of a superabsorbent polymer. For example, sodium polyacrylate can hold 300× its weight in tap water. Because of the high water retention capacity of the absorbent materials of the tarp, the tarp thus weighted can be placed over roof damage and remain in place despite high wind gusts. Because the absorbent entraps the water, if the tarp is torn, it will not leak water and possibly further damage a structure but will merely lose water by evaporation. Unlike solely water filled constructions, because water is entrapped in the absorbent matrix; e.g., cellulose fiber and sodium polyacrylate or other superabsorbent polymer, it may be walked on without fear of bursting and catastrophically leaking fluid. Because the absorbent material is relatively light weight prior to the addition of water, one or more tarp sections may be easily carried up a ladder.

FIG. 14 is a sectional view taken along lines D-D of (FIG. 11);

FIG. 15 is a sectional view taken along lines E-E of (FIG. 11) showing the absorbent material in an unexpanded dry state;

FIG. 16 is a view thereof showing the absorbent material in an expanded (wet) state;

FIG. 17 is another view thereof showing the absorbent material in an expanded state with top layer applied;

LISTING OF THE NAMED ELEMENTS

Figure 1:
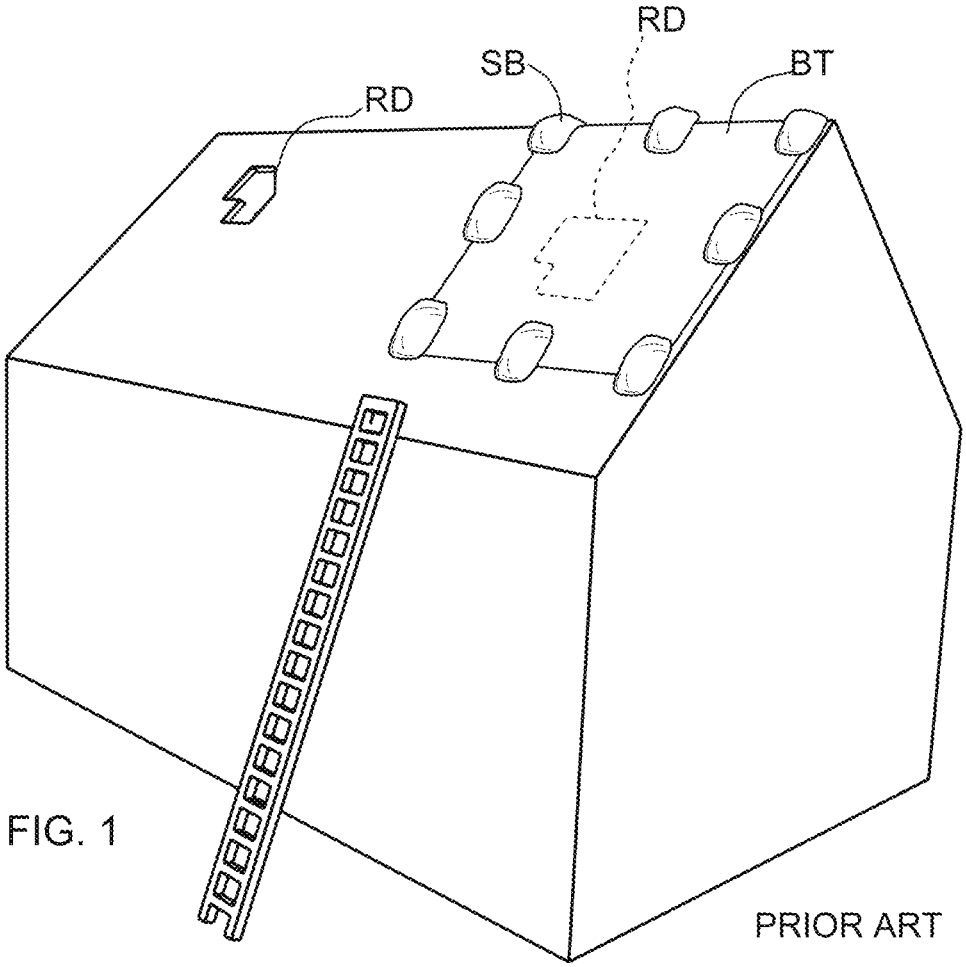
FIG. 1 PRIOR ART
FIG. 1 shows a prior art example of an installed roof tarp weighted down with sandbags.
Figure 2:
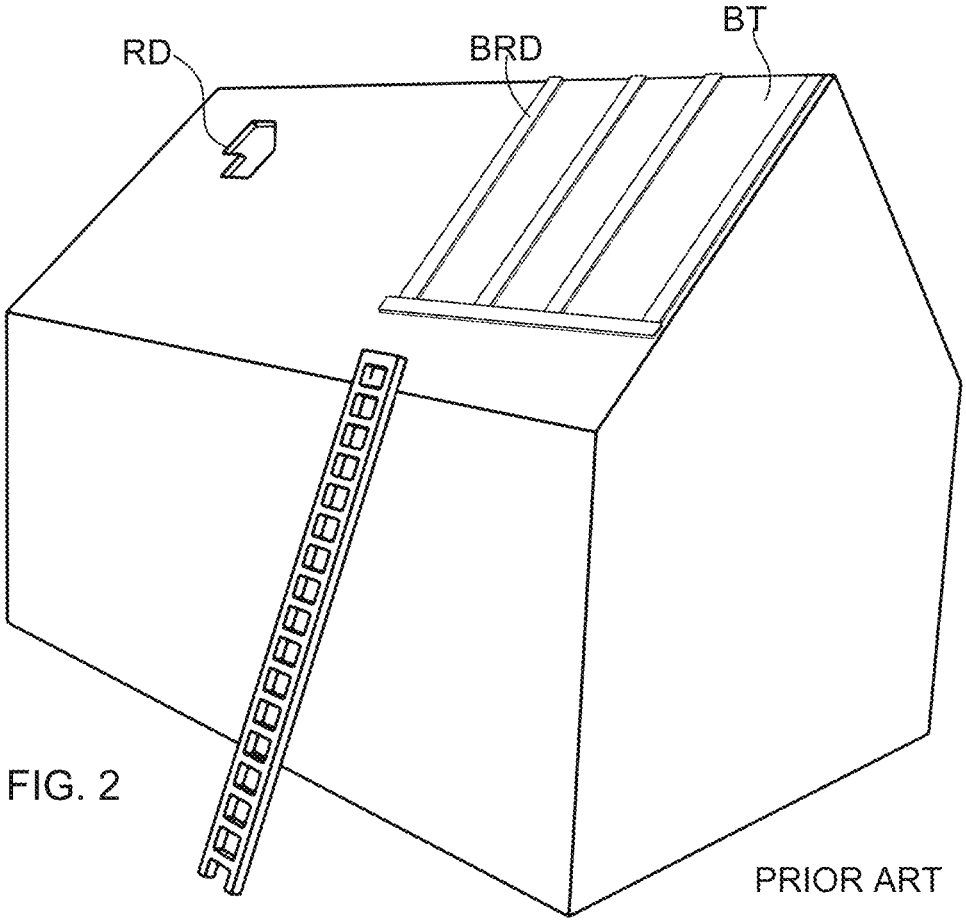
FIG. 2 PRIOR ART
FIG. 2 shows a prior art example of an installed roof tarp using lumber to hold down the periphery of the tarp.

BT blue tarp
SB sandbags
BRDS nailed boards
RF roof
RD roof damage
FS fluid source
100, 101 tarp cover
102 raised sections

103 trough(s)
104 fluid inlet
105A top layer
105B bottom layer
106A flexible hose
106B hose coupling
107 water
108 anti-slip surface
110 perforations
112 absorbent material
113 cavity
114 membrane
116 fluid channel(s)
118 passageway(s)
120 border
122 pull away layer
126 adhesive edge
128 moisture indicator
130 tarp roll

Definitions

Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises" means "includes." All publications, patent applications, patents, and other references listed in this disclosure are incorporated by reference in their entirety for all purposes. In case of conflict, the present specification, including explanations of terms, will control. In addition, the materials, methods, and examples are illustrative only and not intended to be limiting.

DETAILED DESCRIPTION OF THE EMBODIMENTS

Figure 3:
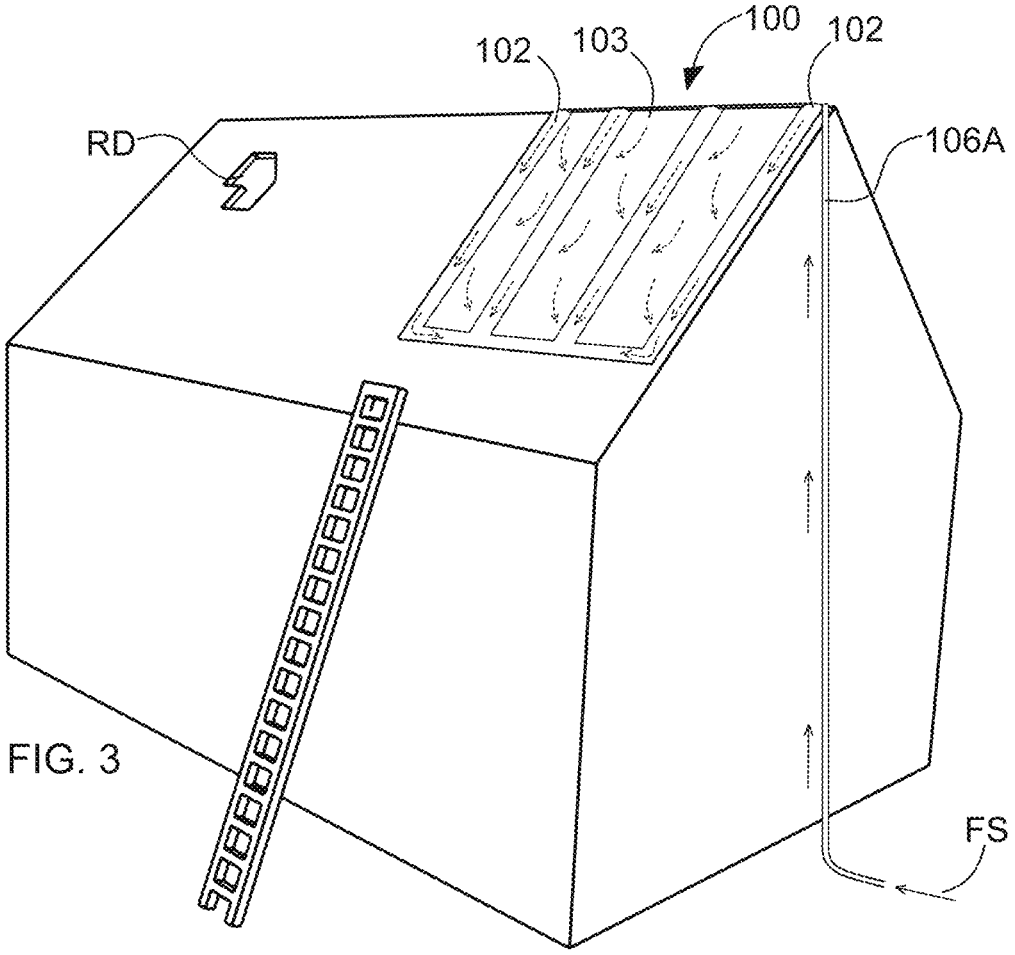
FIG. 3 is a general example implementation according to the present invention showing a tarp that includes absorbent portions that are fluid weighted.

Referring generally to FIGS. 3-14, a protective tarp includes a sandwiched construction with at least a top layer (105A), a bottom layer (105B) and one or more divided cavities (113) between the top and bottom layer, and one or more layers of absorbent material (112) reside in the one or more divided cavities. Generally, the absorbent material includes a cellulose fiber and may also include a superabsorbent polymer such as sodium polyacrylate. The top and bottom layers (105A, 105B) may include a impermiable membrane to resist evaporation of any fluids introduced into the one or more cavities. In some implementations, fluid channels (116) may connect the one or more divided cavities one to another such that fluid introduced into a peripheral cavity will flow into adjacent cavities and hence is absorbed by the absorbent fibers which may include loose fill cellulose packing or non-woven cellulose matting. Typically, the fluid channels (116) may include a plurality of passageways (118) that lead into the cavities with the absorbent material (124). In some implementations, the tarp may be sectioned via perforated lines. In some implementations, multiple tarp sections may be connected along perforated lines and may be packaged on a roll whereby desired lengths of the tarp may be separated from the roll as desired. In some implementations, a flexible hose extending from a tarp may have a water hose connector such that once the tarp is positioned over a damaged roof section as shown in FIG. 3, water may be introduced into the cavities channeled to the absorbent material and thereby weight the tarp sufficiently to prevent displacement by wind or rain. In some implementations the tarp may include a peel-away top layer normally attached at its periphery to the tarp border by an adhesive layer or strip. When the top layer is displaced, instead of distributing the water via fluid inlets and passageways, water may be sprayed directly on the absorbent material and thereby expand the material and entrap the water.

FIG. 3 shows according to the present invention, a general example implementation of a tarp covering a damaged section of roof.

Figure 4:
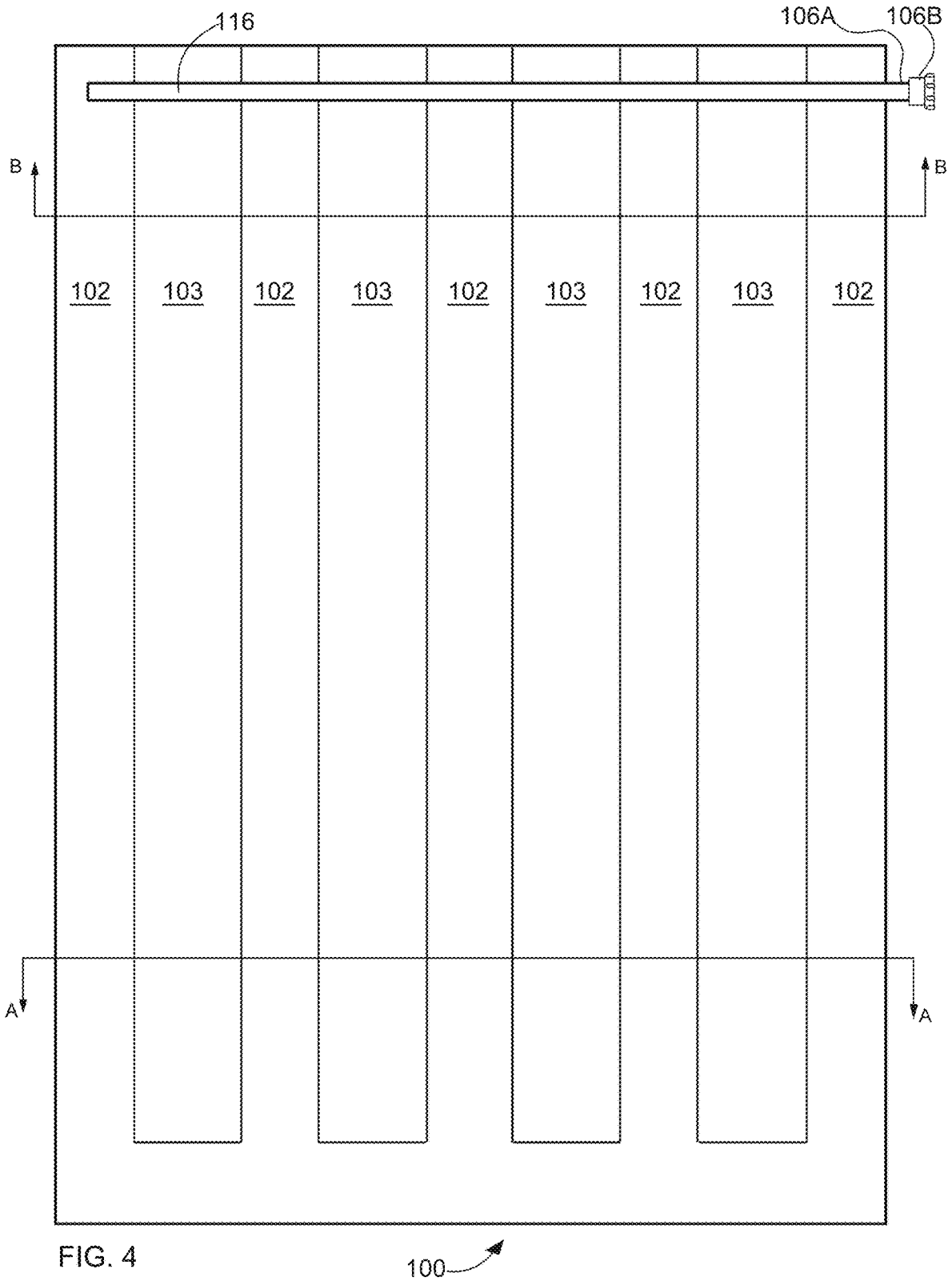
FIG. 4 is a to plan view of an example implementation of a fluid weighted tarp.

FIG. 4 depicts in a top plan view, an example implementation of a tarp (100) including raised portions (102) or ridges, and troughs (103) between the raised portions. A flexible hose (106A) is connectable to a water hose via hose coupling (106B). A fluid channel (116) bridges the raised portions and troughs of the tarp. Fluid inlets form passageways between the channel(s) (116) and the absorbent material (112) residing in cavities in the sandwiched construction of the tarp.

Figure 5:
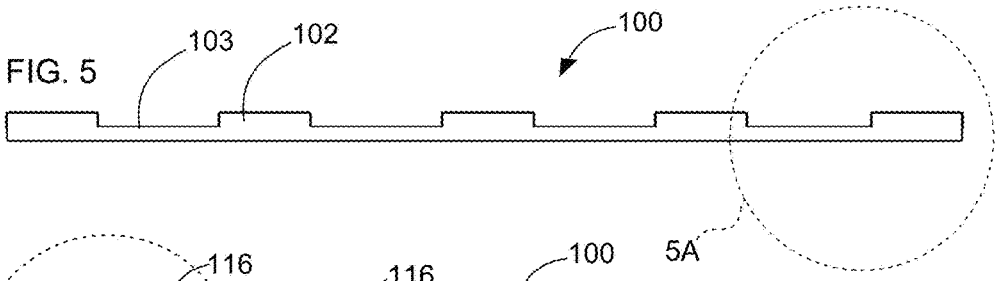
FIG. 5 is a cross-sectional view thereof taken along lines A-A.
Figure 6:
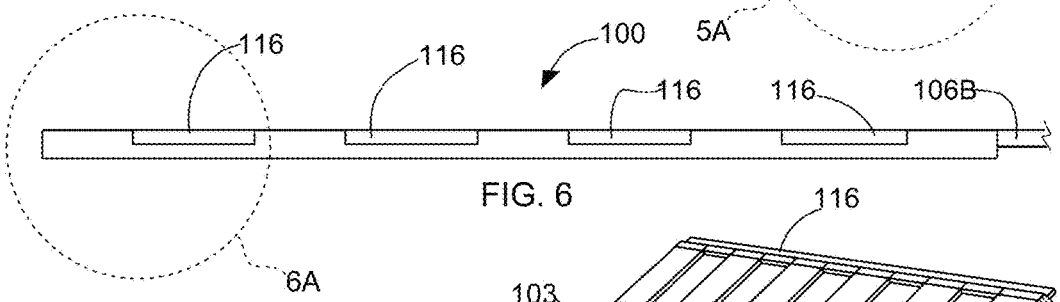
FIG. 6 is another cross-sectional view taken along lines B-B.

FIG. 5 is a cross-sectional view thereof taken along lines A-A of (FIG. 4) showing alternating raised (102) and recessed portions (103) filled with absorbent material. FIG. 6 is another cross-sectional view taken along lines B-B of (FIG. 4) that show a bridging channel (116) that extends across and/or through the top depending on the implementation. In any case the channel includes plural passageways which allow the water to pass from the channel which may reside externally.

Figure 7:
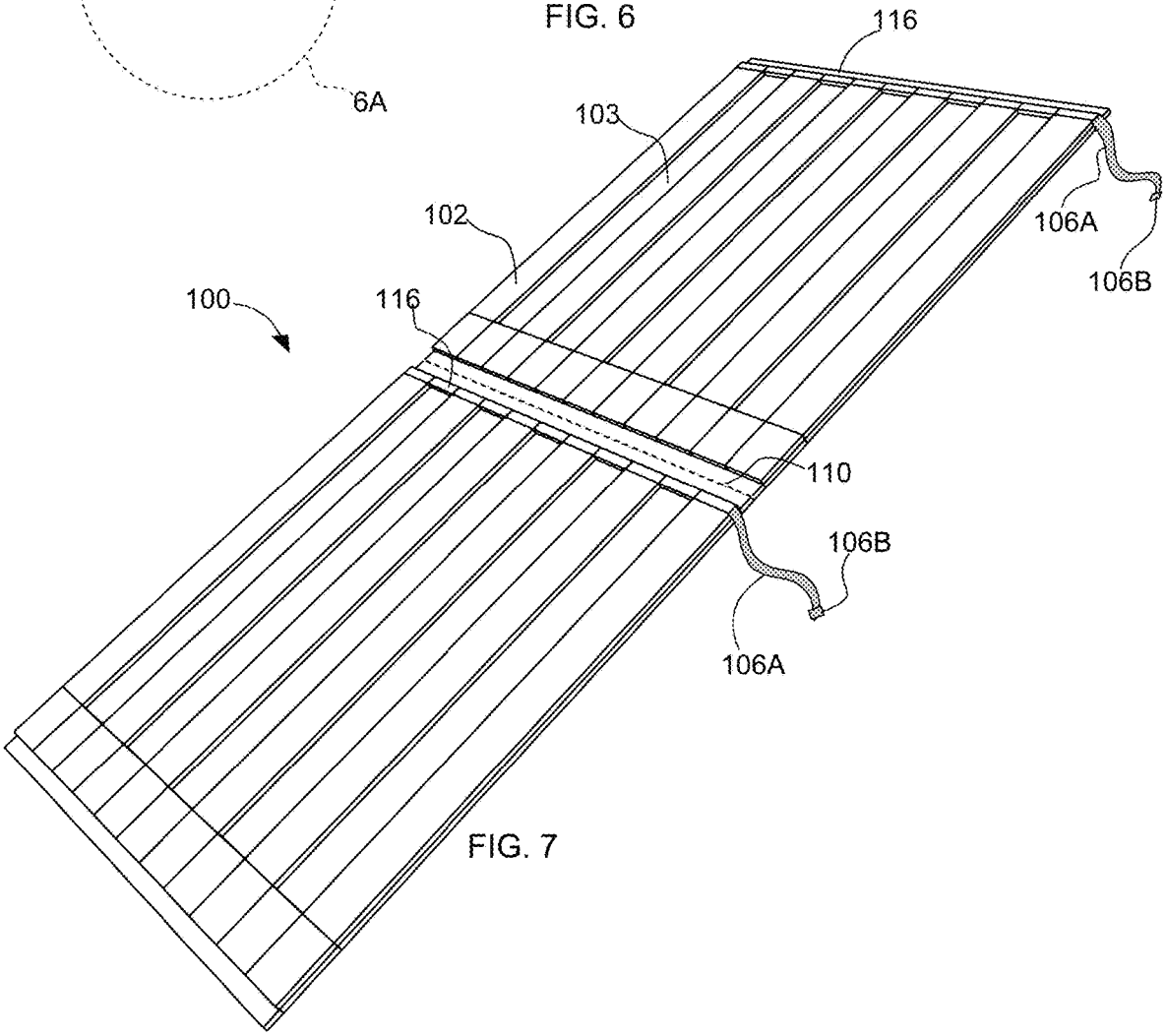
FIG. 7 is an example implementation showing a connected pair of tarps such as that shown in (FIG. 4), and separable along a perforation.

FIG. 7 is a perspective view of a pair of tarp (100) sections joined by a perforated line (110). Each tarp section is shown with a flexible hose extension (106A) which may include a hose coupling (106B) for connection to a water hose. In some implementations, the flexible hose transitions to a integrated fluid channel (116) with passageways (118) leading into the absorbent material (112). In some implementations described herein, the tarp may be faced with a plastic film defining a top (105A) or bottom layer (105B) between which is one or more layers of absorbent material which may be a loose fill or a non-woven mat such that one or more cavities are partially filled, and such absorbent material swells to completely fill the cavities when wetted. In some implementations, the top layer may include gussets or slack allowing the layer to expand as the absorbent swells.

Figure 8:
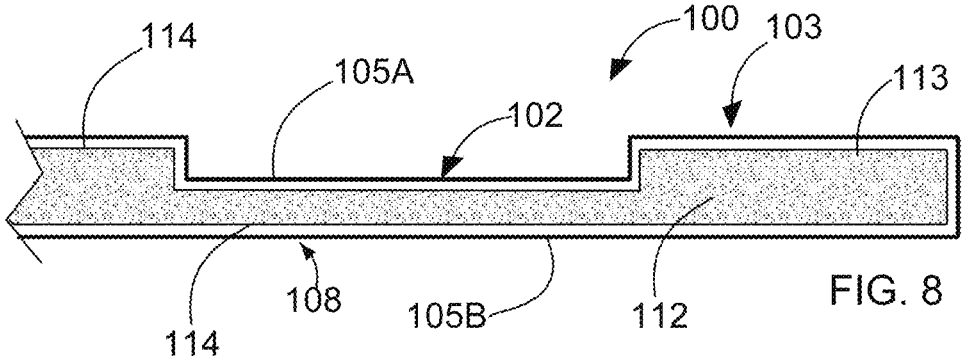
FIG. 8 is an enlarged partial view taken from call-out (5A) of (FIG. 5)

FIG. 8 is an enlarged detail view of call-out (5A) of (FIG. 5) showing an encapsulated layer of absorbent material (112). Top and bottom layers (105A, 105B) may include a water permeable membrane (114) facing the absorbent material (112) such that if the top layer (105A) is displaced, water (107) may be sprayed over the absorbent material without displacing the material in the case where the absorbent material is in loose fill form.

Figure 9:
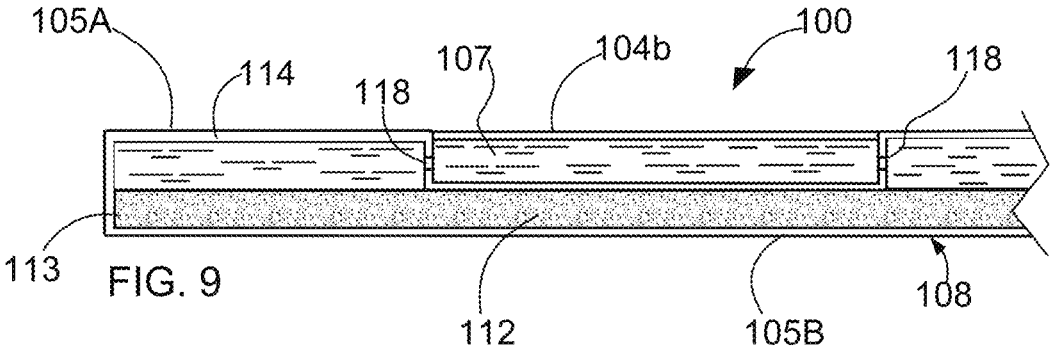
FIG. 9 is an enlarged partial view taken from call-out (6A) of (FIG. 6)

FIG. 9 is an enlarged detail view of call-out (6A) of (FIG. 6) showing an encapsulated layer of absorbent material (112) and embedded channel (116) that bridges the trough portions (103) and includes passageways (118) from the channel into the raised portions (102) such that water passes from the channel to the absorbent material in the one or more cavities of the tarp.

Figure 10:
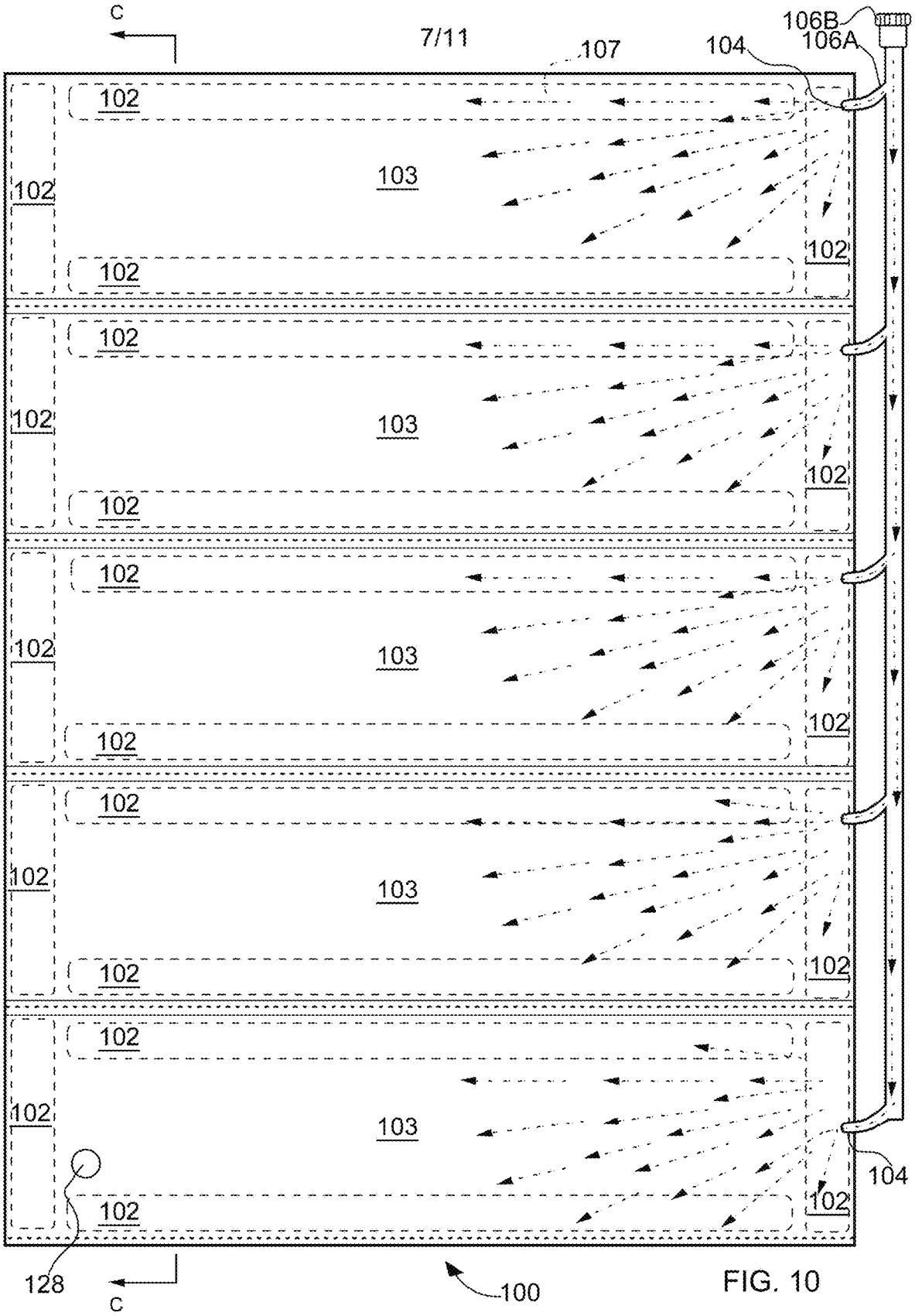
FIG. 10 is a top plan view of a second example implementation of a fluid weighted tarp.

FIG. 10 in a top plan view depicts another implementation where a flexible hose (106A) connected to a water feed line is adapted to feed water as indicated by the dot-dash lines and arrows, between the top and bottom layers (105A, 105B) via inlet(s) (104) and saturate the absorbent material (112) sandwiched between the top and bottom layers where the water is wicked to the central regions and beyond. The absorbent material becomes uniformly saturated entrapping the water and adding significantly (e.g., 10×-300×) to the weight of the tarp. Raised portions (102) adjacent the periphery of the tarp concentrate relatively more weight to the outer edges of the tarp to resist wind undermining and ensure the tarp construction will remain in position during adverse wind conditions.

Figure 11:
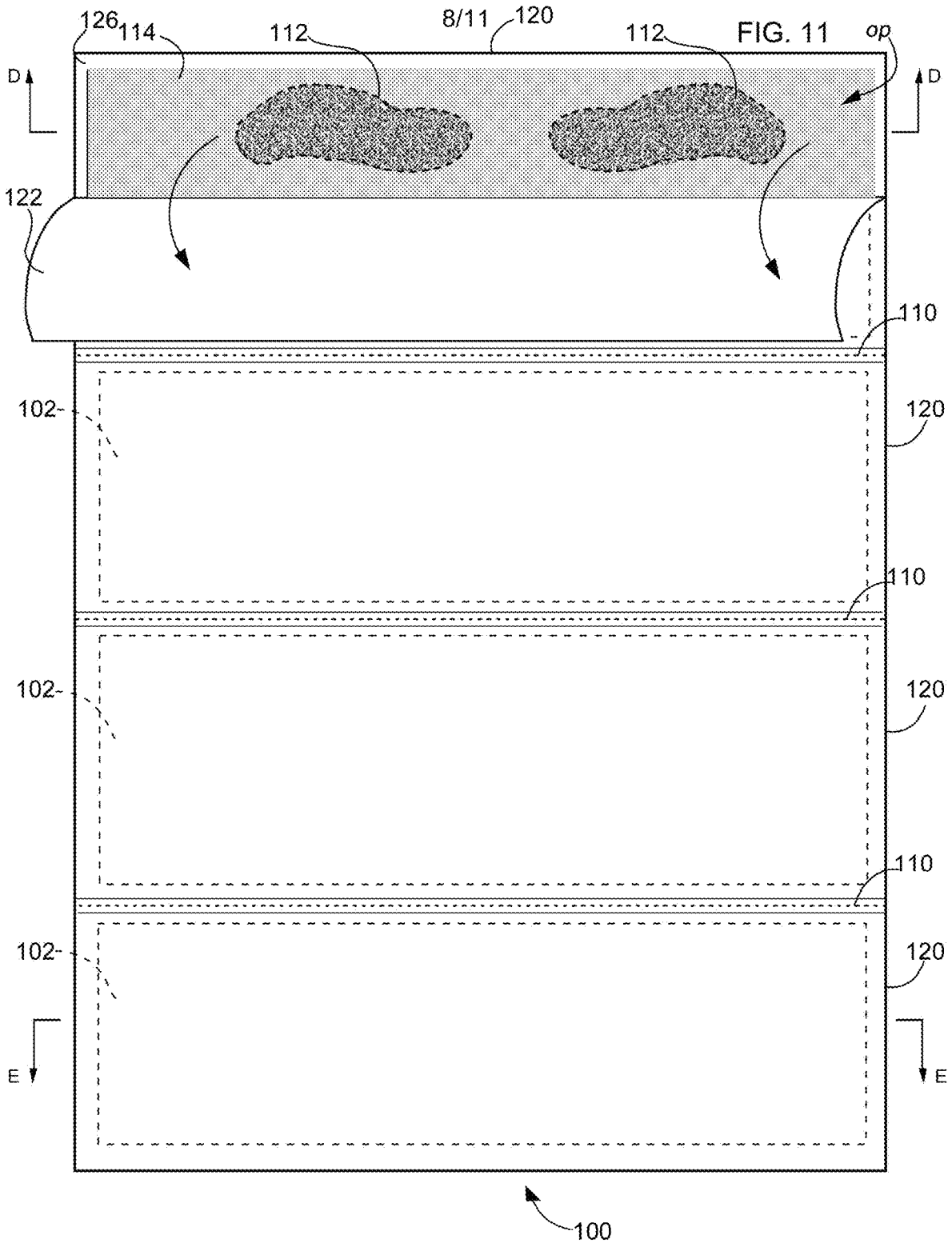
FIG. 11 is a top plan view of a third example implementation of a fluid weighted tarp.

FIG. 11 depicts an example implementation with a peel-away layer (122) forming an opening (op) that exposes the absorbent material (112). In some implementations, a water permeable layer (114) is disposed atop the absorbent material and beneath the top layer (105A). Typically, once the tarp is positioned over the roof damage, the top layer is pulled back so that water (e.g., from a water hose or bucket) may be poured through the permeable layer (114) and saturate it. After a sufficient amount of water is added, the top layer may be reattached about the border (120) of the tarp by an adhesive layer/strip (126). The amount of water to fully saturate the internally disposed absorbent material will of course vary depending on the amount of absorbent material and the size of tarp. In some implementations, a color indicator for moisture (128) may be placed anywhere on the tarp, for example, at an opposite corner or side from a pouring region or a water inlet (104).

Figure 12:
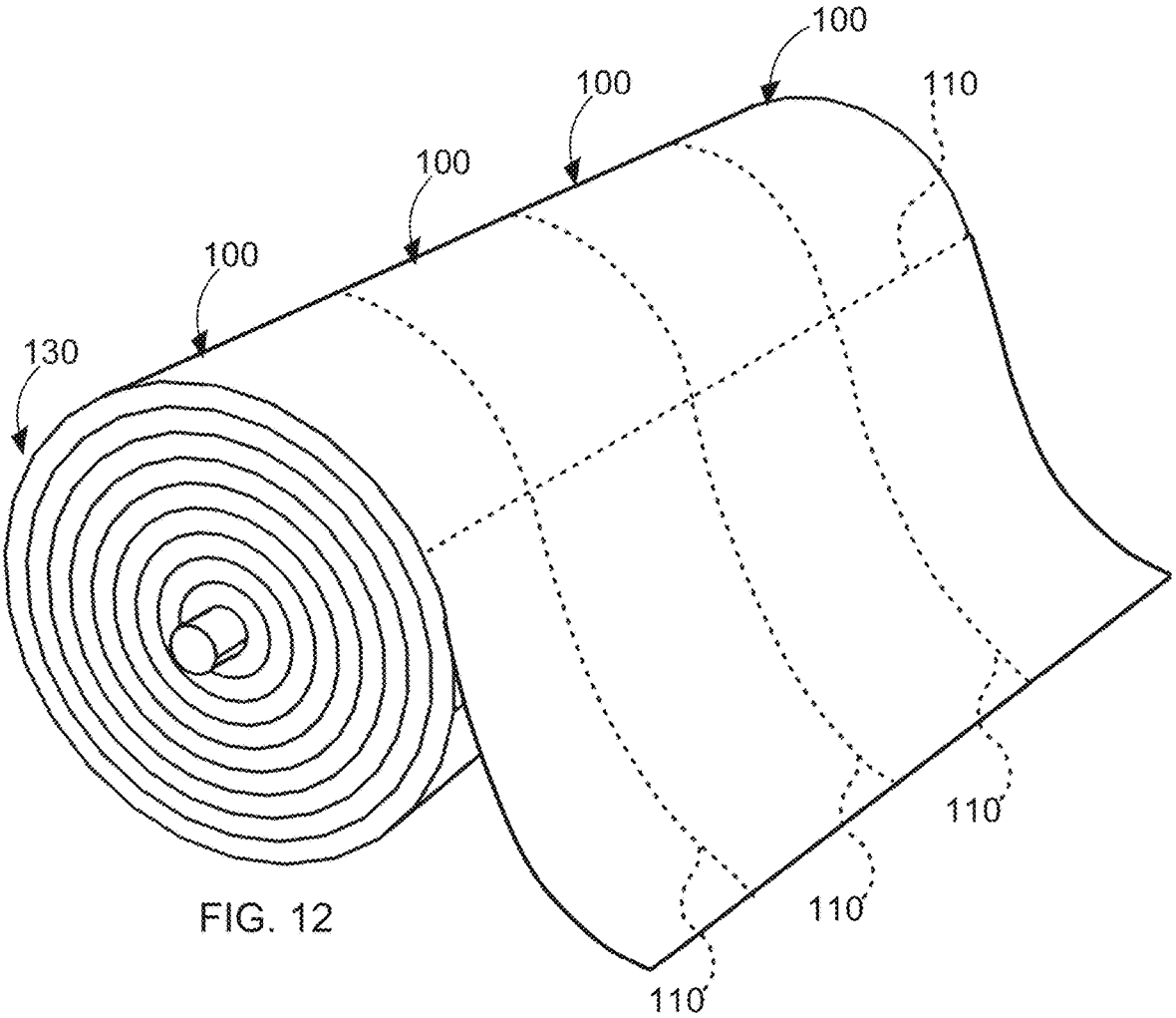
FIG. 12 is a perspective view of a tarp roll.

FIG. 12 shows a roll (130) of tarp portions (100) that are separable along perforated lines (110).

Figure 13:
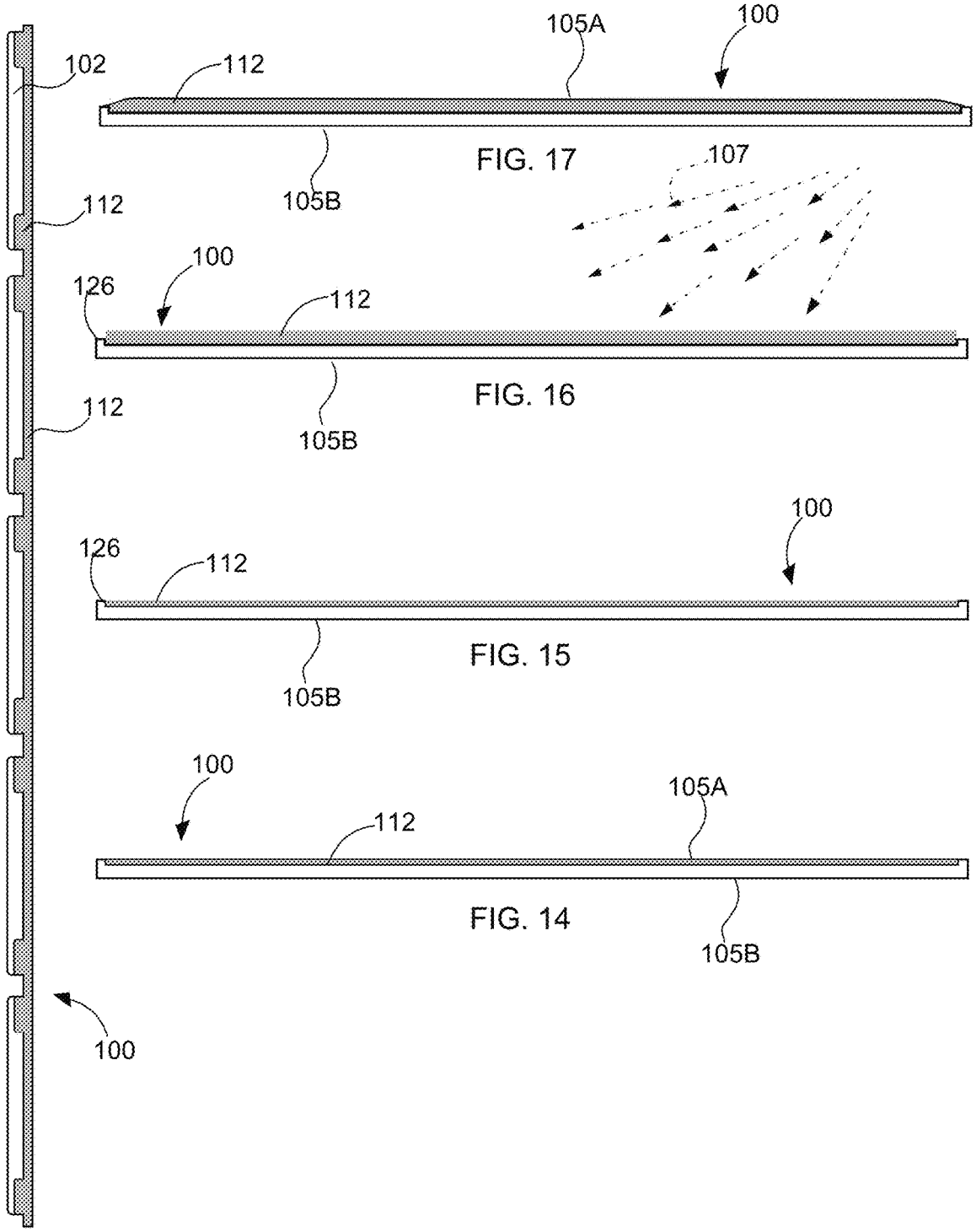
FIG. 13 is a sectional view taken along lines C-C of (FIG. 7)

FIG. 13 is a sectional view taken along lines C-C of (FIG. 7) showing a mat with raised portions (102) adjacent the border wherein the raised portions include additional absorbent material and hence are relatively heavier per square in of mat area than the non-raised regions (103).

FIG. 14 is a sectional view taken along lines D-D of (FIG. 11) where the peel-away top layer is in place covering the absorbent material (112).

FIG. 15 is a sectional view taken along lines E-E of (FIG. 11) showing the absorbent material in an unexpanded dry state prior to the addition of water.

FIG. 16 is another view thereof showing the absorbent material in an expanded (wet) state.

FIG. 17 is another view thereof showing the absorbent material in an expanded state with top layer applied and re-adhered to an adhesive layer/strip (126) about the border of the tarp. A permeable layer (114) of material may reside between the absorbent layer (112) and the top layer (105A) which may include be any material that is permeable to water such as woven and non-woven polyester.

Figure 18:
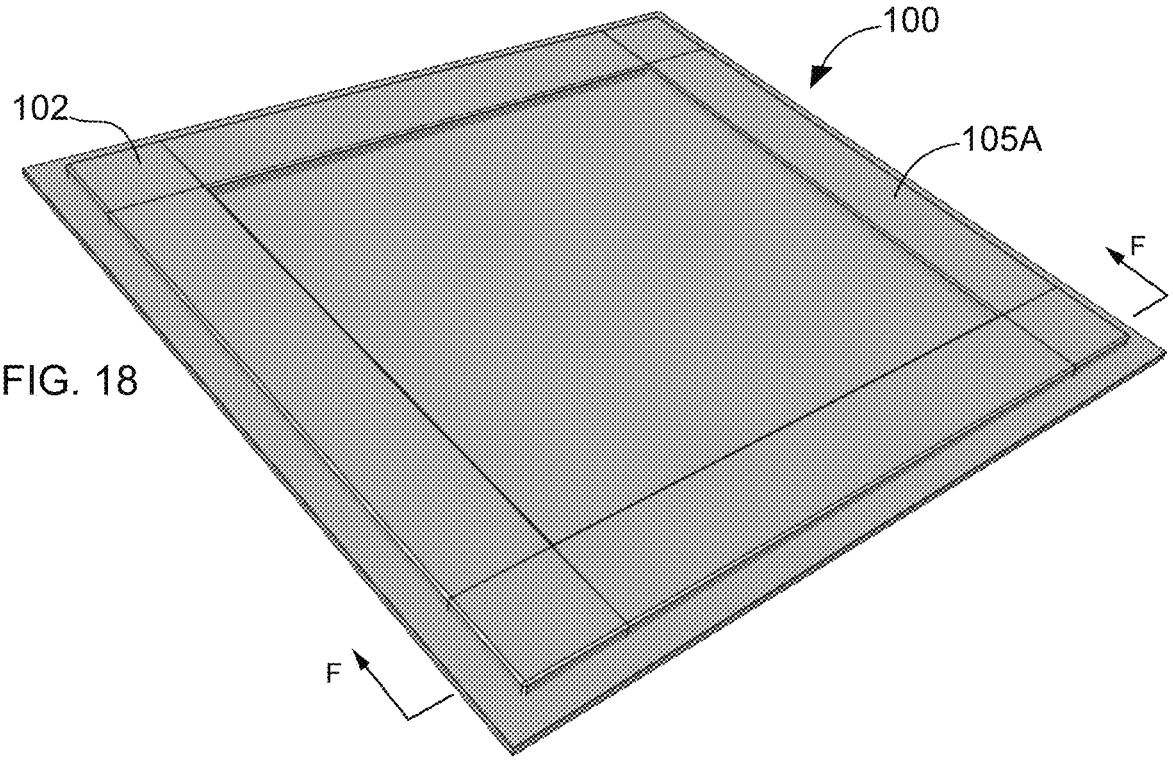
FIG. 18 is a perspective view showing a sub-unit of a tarp bounded by perforated tear lines.
Figure 19:
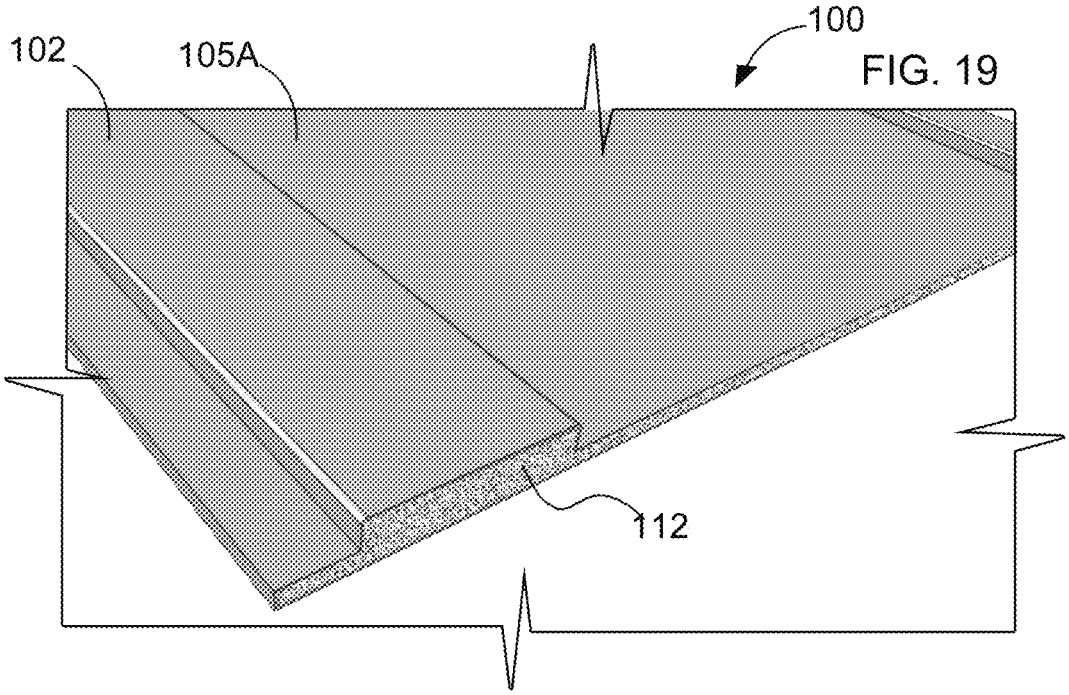
FIG. 19 is a partial cross-sectional view thereof taken along lines F-F.

FIG. 18 is a tarp sub-unit showing the raised and non-raised (trough) portions and FIG. 19 is a cross-sectional view thereof taken along lines F-F.

Manufacture of the various implementations described may involve the following steps creating a negative mold; inserting a bottom layer of material which may be a plastic sheet material; applying a vacuum to the underside of the sheet material; adding absorbent material in a loose form, a woven form or a non-woven form; adding a top layer of plastic sheet that may include flexible hoses, integrated channels, fluid passageways, water inlets, peel-away sections; and, wherein the top layer is joined to the bottom layer at least along its edges by heat sealing, plastic welding or adhesive; removing the tarp from the mold.

It is intended that this disclosure encompass any further modifications, changes, rearrangements, substitutions, alternatives, design choices, and embodiments as would be appreciated by those of ordinary skill in the art having benefit of this disclosure, and falling within the spirit and scope of the following claims.

What is claimed is:

1. A tarp system comprising:

a top layer, a bottom layer, one or more cavities between the top and bottom layer forming a sandwiched construction with an outer border:

one or more layers of fluid absorbent material with a first thickness between the top and bottom layer;

one or more openings for fluid introduction to the one or more cavities, and wherein temporarily displaceable peel away sections are atop the one or more openings, the peel away sections defining an evaporative barrier.

2. The tarp system according to claim 1, the one or more layers of fluid absorbent material include cellulose fiber.

3. The tarp system according to claim 1, including one or more fluid carrying channels between the top and bottom layer.

4. The tarp system according to claim 1, wherein the sandwiched construction includes one or more separable sub-sections.

5. The tarp system according to claim 1, wherein the top and bottom layers include one or more of the following materials: polyester, nylon, polyethylene, polypropylene.

* * * * *